US006901762B2

(12) United States Patent
Irie et al.

(10) Patent No.: US 6,901,762 B2
(45) Date of Patent: Jun. 7, 2005

(54) DEVICE AND METHOD FOR PRESSURE CONTROL OF CARGO TANK OF LIQUEFIED NATURAL GAS CARRIER

(75) Inventors: Toshikazu Irie, Osaka (JP); Norio Hatanaka, Osaka (JP); Takashi Mihashi, Yokohama (JP); Eiji Tominaga, Yokohama (JP); Kazuhiko Ohtake, Nagasaki (JP); Masaru Oka, Nagasaki (JP); Moritaka Nakamura, Yokohama (JP); Motohiro Omori, Machida (JP)

(73) Assignees: Osaka Gas Co., Ltd., Osaka (JP); Nippon Yusen Kabushiki Kaisha, Tokyo (JP); Mitsubishi Heavy Industries, Ltd., Tokyo (JP); Chiyoda Corporation, Kanagawa (JP)

( * ) Notice: Subject to any disclaimer, the term of this patent is extended or adjusted under 35 U.S.C. 154(b) by 0 days.

(21) Appl. No.: 10/415,928

(22) PCT Filed: May 17, 2001

(86) PCT No.: PCT/JP01/04106

§ 371 (c)(1),
(2), (4) Date: Apr. 10, 2003

(87) PCT Pub. No.: WO02/095285

PCT Pub. Date: Nov. 28, 2002

(65) Prior Publication Data

US 2004/0068993 A1 Apr. 15, 2004

(51) Int. Cl.[7] ..... F17C 3/10; F25J 1/00

(52) U.S. Cl. ..... 62/48.2; 62/614

(58) Field of Search ..... 62/48.2, 48.3, 62/613, 614

(56) References Cited

U.S. PATENT DOCUMENTS

| | | | | | |
|---|---|---|---|---|---|
| 3,857,245 | A | * | 12/1974 | Jones | 60/651 |
| 3,857,251 | A | * | 12/1974 | Alleaume | 62/623 |
| 3,877,240 | A | * | 4/1975 | Kniel et al. | 62/48.2 |
| 3,919,852 | A | * | 11/1975 | Jones | 62/7 |
| 4,637,216 | A | * | 1/1987 | Shenoy et al. | 62/47.1 |
| 5,036,671 | A | | 8/1991 | Nelson et al. | |
| 6,449,983 | B2 | * | 9/2002 | Pozivil | 62/613 |
| 6,530,241 | B2 | * | 3/2003 | Pozivil | 62/619 |

FOREIGN PATENT DOCUMENTS

| | | | | |
|---|---|---|---|---|
| JP | 59-19799 | | | 2/1984 |
| JP | 59-216785 | A | * | 6/1984 |
| JP | 62-17355 | | | 1/1987 |
| JP | 1-320400 | A | * | 12/1989 |
| JP | 11-51295 | | | 2/1999 |
| JP | 11-82895 | A | * | 3/1999 |
| JP | 11-190498 | A | * | 7/1999 |
| JP | 11-210993 | A | * | 8/1999 |
| JP | 2001-132896 | | * | 5/2001 |

* cited by examiner

*Primary Examiner*—William C. Doerrler
(74) *Attorney, Agent, or Firm*—Wenderoth, Lind & Ponack, L.L.P.

(57) ABSTRACT

An apparatus for controlling the pressure in a cargo tank 1 supplies BOG generated from liquefied natural gas stored in the cargo tank 1 to a burning system 6 through a compressor. In this apparatus, a reliquefaction plant 5 is disposed on the downstream side of first and second compressors 3 and 4 and on the upstream side of the cargo tank 1 so that BOG discharged from the second compressor 4 is liquefied by the reliquefaction plant 5 and the liquefied fluid is returned again into the cargo tank 1.

6 Claims, 4 Drawing Sheets

DEVICE AND METHOD FOR PRESSURE CONTROL OF CARGO TANK OF LIQUEFIED NATURAL GAS CARRIER

TECHNICAL FIELD

The present invention relates to an apparatus and a method for controlling pressure in a cargo tank on a liquefied natural gas (hereinafter referred to as LNG) carrier especially mounted with a reliquefaction plant.

BACKGROUND ART

In general, an LNG carrier is provided with a plurality of cargo tanks 51 as shown in FIG. 4. The cargo tank 51 stores low-temperature (about −162° C.) LNG, loaded at a loading site, at atmospheric pressure and carries it to an unloading site of destination. On this voyage, the pressure in the cargo tank 51 is increased by boil-off gas (hereinafter referred to as BOG) generated from the stored LNG.

Therefore, on a conventional LNG carrier, in order to control the cargo tank pressure so as to be within a specified range to avoid the increase in pressure in the cargo tank 51, the cargo tank 51 is connected to a burning system (a complete system for using BOG as boiler fuel) 52 via regulating valves 53, a compressor 54, and the like, so that BOG evaporating from the cargo tank 51 is compressed by the compressor 54 and then is supplied to the burning system 52, where the BOG is burned. The LNG carrier is provided with a standby compressor 55 having the same construction as that of the compressor 54. This standby compressor 55 is disposed in parallel with the compressor 54 in case the compressor 54 should fail.

After LNG is unloaded at the unloading site, the LNG carrier makes her voyage in a ballast condition again to the loading site. At this time, LNG of about 2% of its quantity at the full load time is left in the cargo tank 51. The reason for this is that the tank is then prevented from being damaged by sudden loading of low-temperature LNG in a complete ballast condition.

On such a voyage in a ballast condition, since the temperature in the cargo tank 51 rises, the remaining low-temperature LNG is sprayed by a spray pump, not shown, via the regulating valve 53 to cool a plurality of locations at the bottom part and the upper part of the cargo tank 51 while the temperature state in the tank is observed.

It is more advantageous in terms of cost to return BOG generated in the cargo tank 51 into the cargo tank 51 and recover it for use as original LNG than to use the BOG as an auxiliary fuel for a boiler and the like.

In the above-described conventional method for controlling the pressure in the cargo tank 51, however, a system is used in which BOG generated in the cargo tank 51 passes through the compressor 54 (or the standby compressor 55) and is supplied to the burning system 52, where the BOG is burned. Therefore, the BOG is used merely as an auxiliary fuel for a boiler and the like, so that it is difficult to meet a demand for cost reduction.

DISCLOSURE OF THE INVENTION

The present invention has been made in view of the above situation, and accordingly an object thereof is to provide an apparatus and a method for controlling pressure in a cargo tank in which BOG generated in the cargo tank can be treated safely, and the pressure in the cargo tank can surely be controlled so as to be within a specified range without a significant increase in equipment cost, and also cost reduction can be attained.

To solve the problems with the above-described prior art, the present invention provides an apparatus for controlling pressure in a cargo tank in which BOG generated from liquefied natural gas stored in the cargo tank is compressed by a compressor. A reliquefaction plant is disposed on the downstream side of the compressor and on the upstream side of the cargo tank so that the BOG discharged from the compressor is liquefied by the reliquefaction plant and the liquefied fluid is returned again into the cargo tank.

As described above, the apparatus for controlling pressure in a cargo tank on an LNG carrier in accordance with the present invention is configured so that BOG generated from liquefied natural gas stored in the cargo tank is added or changed through a compressor so as to control the pressure in the cargo tank. A reliquefaction plant is disposed on the downstream side of the compressor and on the upstream side of the cargo tank so that the BOG discharged from the compressor is liquefied by the reliquefaction plant and the liquefied fluid is returned again into the cargo tank. Therefore, BOG generated in the cargo tank can be treated safely and the pressure in the cargo tank can surely be controlled so as to be within a specified range without a significant increase in equipment cost. Also, cost reduction can be attained as compared with the case where BOG is used as a fuel in the normal operation and is burned in a burning system.

Also, in the present invention, two compressors connected in series are disposed on the upstream side of the reliquefaction plant.

Also, in the present invention, a mist separator is disposed on the downstream side of the cargo tank to keep the supply temperature of BOG supplied to the reliquefaction plant constant, and the mist separator is connected to an inlet portion and an outlet portion of the compressors and also is connected to an outlet portion of the reliquefaction plant.

Also, the present invention provides an apparatus for controlling pressure in a cargo tank on a liquefied natural gas carrier, in which BOG generated from liquefied natural gas stored in the cargo tank is supplied to a burning system through a compressor. First and second compressors are disposed in parallel on the downstream side of the cargo tank, and the burning system is disposed on the downstream side of the first compressor and a reliquefaction plant is disposed on the downstream side of the second compressor and on the upstream side of the cargo tank. The BOG discharged from the second compressor is liquefied by the reliquefaction plant and the liquefied liquid is returned again into the cargo tank.

The apparatus for controlling pressure in a cargo tank on an LNG carrier in accordance with the present invention is configured so that BOG generated from liquefied natural gas stored in the cargo tank is supplied to a burning system through a compressor to control the pressure in the cargo tank, first and second compressors are disposed in parallel on the downstream side of the cargo tank, and the burning system is disposed on the downstream side of the first compressor and the reliquefaction plant is disposed on the downstream side of the second compressor and on the upstream side of the cargo tank. The BOG discharged from the second compressor is liquefied by the reliquefaction plant and the liquefied liquid is returned again into the cargo tank. Therefore, the invention of this mode achieves the same effects as those of the above-described mode of the invention.

Also, in the present invention, a mist separator is disposed on the downstream side of the cargo tank to keep the supply temperature of BOG supplied to the reliquefaction plant constant, and the mist separator is connected to inlet portions of the first and second compressors, connected to an outlet portion of the second compressor, and also connected to an outlet portion of the reliquefaction plant, and a return pump is provided between an inlet portion of the cargo tank and an outlet portion of the mist separator.

Further, the present invention provides a method for controlling pressure in a cargo tank on a liquefied natural gas carrier in which BOG generated from liquefied natural gas stored in the cargo tank is compressed by a compressor. By using a reliquefaction plant disposed on the downstream side of the compressor and on the upstream side of the cargo tank, and a mist separator disposed on the downstream side of the cargo tank, the BOG passing through the mist separator and discharged from the compressor is liquefied by the reliquefaction plant. The liquefied fluid is returned again into the cargo tank. Some of the BOG discharged from the compressor is supplied to the mist separator while being mixed with the BOG evaporating from the cargo tank and some of reliquefied fluid liquefied by the reliquefaction plant is sprayed into the mist separator so that the BOG supplied from the compressor and the cargo tank is cooled by the sprayed reliquefied fluid, whereby the supply temperature of BOG supplied to the reliquefaction plant is kept constant.

In the method for controlling pressure in a cargo tank on a liquefied natural gas carrier in accordance with the present invention, BOG generated from liquefied natural gas stored in the cargo tank is compressed by the compressor to control the pressure in the cargo tank. By using a reliquefaction plant disposed on the downstream side of the compressor and on the upstream side of the cargo tank, and a mist separator disposed on the downstream side of the cargo tank, the BOG passing through the mist separator and discharged from the compressor is liquefied by the reliquefaction plant, and the liquefied fluid is returned again into the cargo tank. Some of the BOG discharged from the compressor is supplied to the mist separator while being mixed with the BOG evaporating from the cargo tank and some of reliquefied fluid liquefied by the reliquefaction plant is sprayed into the mist separator so that the BOG supplied from the compressor and the cargo tank is cooled by the sprayed reliquefied fluid, whereby the supply temperature of BOG supplied to the reliquefaction plant is kept constant. Therefore, the invention of this mode achieves the same effects as those of the above-described mode of invention, and the apparatus can be operated smoothly.

Also, the present invention provides a method for controlling pressure in a cargo tank on a liquefied natural gas carrier, in which BOG generated from liquefied natural gas stored in the cargo tank is supplied to a burning system through a compressor By using a second compressor disposed in parallel with a first compressor, connected with the burning system, on the downstream side of the cargo tank, a reliquefaction plant disposed on the downstream side of the second compressor and on the upstream side of the cargo tank, a mist separator disposed on the downstream side of the cargo tank, and a return pump provided between an inlet portion of the cargo tank and an outlet portion of the mist separator, the BOG passing through the mist separator and discharged from the second compressor is liquefied by the reliquefaction plant, and the liquefied fluid is returned again into the cargo tank through the mist separator and the return pump. Some of the BOG discharged from the second compressor is supplied to the mist separator while being mixed with the BOG evaporating from the cargo tank and some of reliquefied fluid liquefied by the reliquefaction plant is sprayed into the mist separator so that the BOG supplied from the second compressor and the cargo tank is cooled by the sprayed reliquefied fluid, whereby the supply temperature of BOG supplied to the reliquefaction plant is kept constant.

In the method for controlling pressure in a cargo tank on a liquefied natural gas carrier in accordance with the present invention, BOG generated from liquefied natural gas stored in the cargo tank is supplied to a burning system through a compressor, and by using a second compressor disposed in parallel with a first compressor, connected with the burning system, on the downstream side of the cargo tank, a reliquefaction plant disposed on the downstream side of the second compressor and on the upstream side of the cargo tank, a mist separator disposed on the downstream side of the cargo tank, and a return pump provided between an inlet portion of the cargo tank and an outlet portion of the mist separator, the BOG passing through the mist separator and discharged from the second compressor is liquefied by the reliquefaction plant, and the liquefied fluid is returned again into the cargo tank through the mist separator and the return pump. Some of the BOG discharged from the second compressor is supplied to the mist separator while being mixed with the BOG evaporating from the cargo tank and some of reliquefied fluid liquefied by the reliquefaction plant is sprayed into the mist separator so that the BOG supplied from the second compressor and the cargo tank is cooled by the sprayed reliquefied fluid, whereby the supply temperature of BOG supplied to the reliquefaction plant is kept constant. Therefore, the invention of this mode achieves the same effects as those of the above-described mode of invention, and the apparatus can be operated smoothly.

BEST MODE FOR CARRYING OUT THE INVENTION

Figure 1:
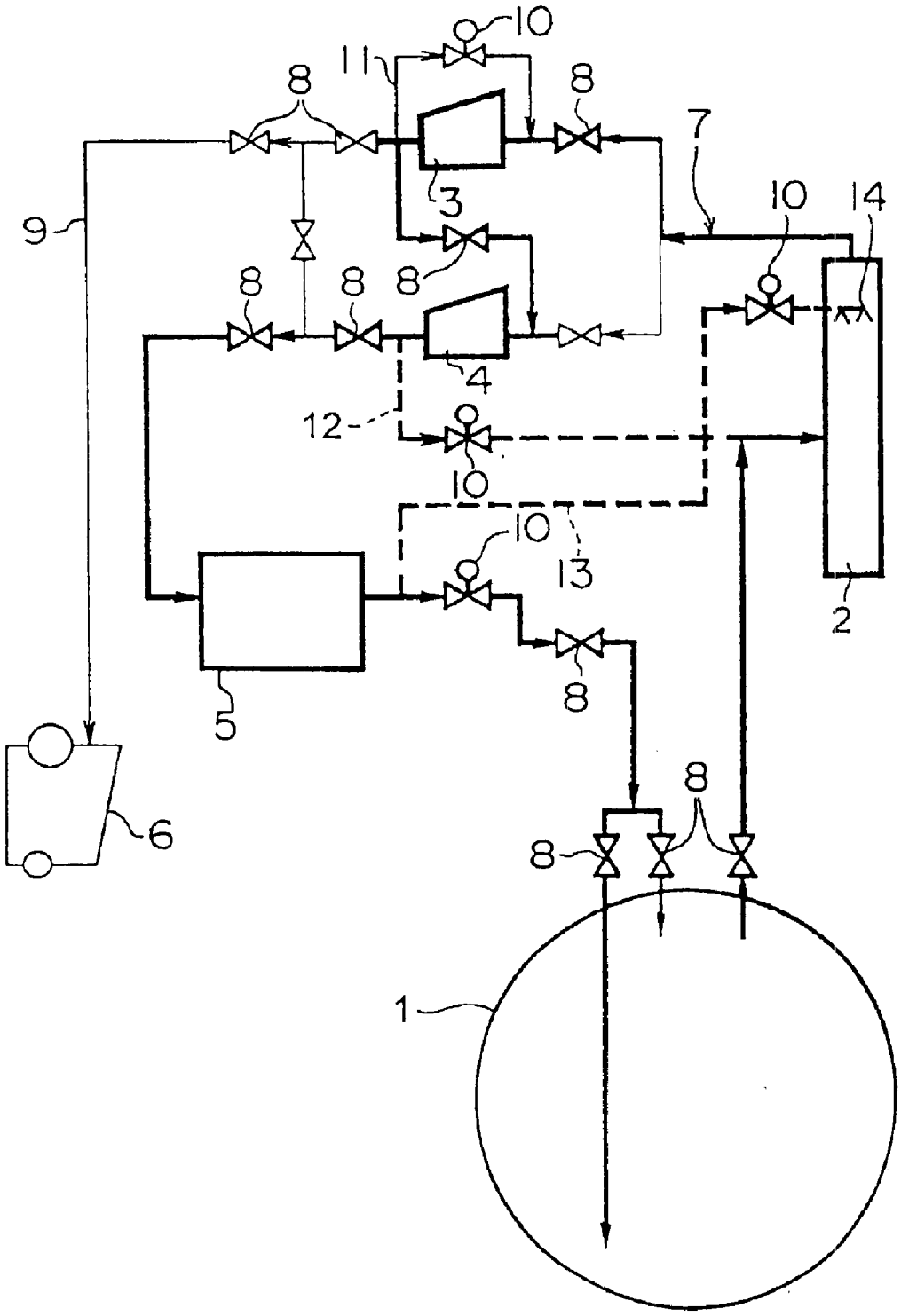
FIG. 1 is a schematic view of a pressure control apparatus for a cargo tank on an LNG carrier in accordance with a first embodiment of the present invention.

The present invention will now be described in detail with reference to embodiments shown in the accompanying drawings. FIG. 1 is a schematic view of a pressure control apparatus for a cargo tank on an LNG carrier in accordance with a first embodiment of the present invention.

As shown in FIG. 1, the pressure control apparatus for a cargo tank on an LNG carrier in accordance with the first embodiment of the present invention includes a plurality of cargo tanks 1 for mainly storing LNG at a low-temperature (about −162° C.) under atmospheric pressure, one mist separator 2, first and second compressors 3 and 4, which are two BOG compressors, a reliquefaction plant 5, and a burning system (for example, a complete system for using BOG as boiler fuel) 6. Moreover, the cargo tank 1, the mist separator 2, the first compressor 3, the second compressor 4, and the reliquefaction plant 5 are connected to each other by a gas circulation main line 7 etc. to recover BOG (boil-off gas containing methane gas etc.) generated from the stored LNG in the cargo tank 1. The apparatus is configured so that the BOG is treated safely and the pressure in the cargo tank 1 is controlled so as to be within a specified range.

The reliquefaction plant 5 for liquefying BOG discharged from the second compressor 4 is disposed on the downstream side of the first and second compressors 3 and 4 and on the upstream side of the cargo tank 1, so that the BOG liquefied by the reliquefaction plant 5 is returned again into the cargo tank 1 to be recovered and stored therein.

The first and second compressors 3 and 4 are disposed on the upstream side of the reliquefaction plant 5, and are connected in series so as to compress BOG at two stages. This high compressing operation facilitates the liquefaction of BOG effected by the reliquefaction plant 5. The first compressor 3 is provided on the upstream side of the second compressor 4, and these two compressors 3 and 4 are connected to each other via the gas circulation main line 7 and a regulating valve 8.

On the downstream side of the first compressor 3, there is disposed the burning system 6 which is used, for example, when the reliquefaction plant 5 fails and becomes incapables of continued operation. The burning system 6 is connected to the first compressor 3 via regulating valves 8 and a BOG burning line (for example, a boiler combustion line) 9. Also, the first compressor 3 is provided with a control valve 10 for use in preventing surging, which makes the first compressor 3 inoperative in relation to the surging. This control valve 10 is provided at a halfway position of a branch line 11 that connects an inlet portion of the first compressor 3 to an outlet portion thereof, and is configured so that BOG can be compressed repeatedly until the quantity of BOG reaches a predetermined value.

As described above, the reliquefaction plant 5 connected to the second compressor 4 via the gas circulation main line 7 and regulating valves 8 is disposed on the downstream side of the second compressor 4 and on the upstream side of the cargo tank 1. The reliquefaction plant 5 is connected to an outlet portion of the cargo tank 1 via the gas circulation main line 7, a control valve 10 and regulating valves 8.

On the other hand, on the downstream side of the cargo tank 1 and at a halfway position of the gas circulation main line 7, the mist separator 2 is disposed to keep the supply temperature of BOG supplied to the reliquefaction plant 5 constant. An upper outlet portion of the mist separator 2 is connected to the inlet portion of the first compressor 3 via a regulating valve 8, and an intermediate portion thereof is connected to an outlet portion of the second compressor 4 via a first sub-line 12 and a control valve 10. Both ends of the first sub-line 12 communicate with the gas circulation main line 7 connected to the intermediate portion of the mist separator 2.

Also, the upper part of the mist separator 2 is connected to an outlet portion of the reliquefaction plant 5 via a second sub-line 13 and a control valve 10. An end on the mist separator side of the second sub-line 13 is connected to a spray nozzle 14 for spraying some of reliquefied liquid. Most of reliquefied liquid discharged from the reliquefaction plant 5 blows off from a plurality of locations at the bottom part and upper part of the cargo tank 1 via a plurality of regulating valves 8 according to the temperature state of the cargo tank 1 so that the cargo tank 1 is cooled by the reliquefied liquid.

The following is a description of a method for controlling the pressure in the cargo tank 1 by using the pressure control apparatus in accordance with the first embodiment of the present invention.

In the case where the reliquefaction plant 5 is operated at a capacity close to the maximum capacity, BOG evaporating from the cargo tank 1 passes through the regulating valve 8, the gas circulation main line 7, and the mist separator 2, and is sent to the reliquefaction plant 5 while being compressed by the first and second compressors 3 and 4 operated in series. The BOG is liquefied by the reliquefaction plant 5. Subsequently, the liquefied liquid is returned directly into the cargo tank 1 through the control valve 10 and the regulating valves 8 and is recovered. The throughput of BOG is regulated by the capacity control of the first and second compressors 3 and 4.

Also, when the first and second compressors 3 and 4 are operated at a low capacity, the pressure approaches a surge region.

To solve this problem, the control valve 10 in the first sub-line 12 is opened to cause the outlet portion of the second compressor 4 to communicate with the gas circulation main line 7, by which the outlet portion of the second compressor 4 is connected to the mist separator 2. Thus, some of BOG discharged from the second compressor 4 is supplied to the mist separator 2 while being mixed with BOG evaporating from the cargo tank 1. At the same time, the control valve 10 in the second sub-line 13 is opened to cause the outlet portion of the reliquefaction plant 5 to communicate with the spray nozzle 14, by which some of reliquefied liquid liquefied by the reliquefaction plant 5 is sprayed into the mist separator 2 from the upside by using the spray nozzle 14. Thereby, some of BOG discharged from the second compressor 4 is further cooled by the reliquefied liquid liquefied by the reliquefaction plant 5 while being mixed with low-temperature BOG evaporating from the cargo tank 1. Therefore, the supply temperature of BOG supplied to the reliquefaction plant 5 through the mist separator 2 and the first and second compressors 3 and 4 is kept constant.

On an LNG carrier on a voyage in a ballast condition, the need for cooling spray work of the cargo tank 1 performed by the operation of a spray pump, which work has been carried out conventionally, can be eliminated by the spraying of the reliquefied liquid sent from the reliquefaction plant 5 into the cargo tank 1.

On the other hand, in the case where BOG treatment at the minimum or lower capacity of the reliquefaction plant 5 is required, the reliquefaction plant 5 is operated in the cold keep operation state or stopped. Also, when the reliquefaction plant 5 fails and becomes incapable of continued operation, BOG is quickly transferred to the line for burning. Specifically, the regulating valve 8 between the first compressor 3 and the second compressor 4 is closed, and the regulating valves 8 in the BOG burning line 9 is opened to operate a single BOG compressor, by which the first compressor 3 is connected to the burning system 6. Thus, BOG discharged from the first compressor 3 passes through the regulating valves 8 and the BOG burning line 9, and is supplied to the burning system 6, where the BOG is burned, by which the pressure in the cargo tank 1 is controlled.

According to the apparatus for controlling the pressure in the cargo tank 1 in accordance with the first embodiment of the present invention and the method for controlling the pressure using this apparatus, the reliquefaction plant 5 for treating BOG generated in the cargo tank 1 is provided so that at the time of normal operation, BOG evaporating from the cargo tank 1 is supplied to the reliquefaction plant 5 through the first and second compressors 3 and 4 disposed in series, and BOG is liquefied by the reliquefaction plant 5 into reliquefied liquid, which is returned into the cargo tank 1. Therefore, the pressure in the cargo tank 1 can surely be controlled so as to be within a specified range. Also, this apparatus and method are advantageous in terms of economy as compared with the case where BOG is burned by the burning system 6 at the time of normal operation.

Also, according to the pressure control apparatus of this embodiment and the method for controlling the pressure using this apparatus, there is provided the mist separator 2 which is connected to the inlet portion of the first compressor 3 via the gas circulation main line 7 etc., connected to the outlet portion of the second compressor 4 via the first sub-line 12 etc., and connected to the outlet portion of the reliquefaction plant 5 via the second sub-line 13 etc. Therefore, even if the outlet temperature of the first and second compressors 3 and 4 disposed in series increases, some of BOG discharged from the second compressor 4 is supplied to the mist separator 2 while being mixed with the BOG evaporating from the cargo tank 1, and some of reliquefied liquid sent from the reliquefaction plant 5 is supplied to the spray nozzle 14 to be sprayed into the mist separator 2. Thereby, BOG including some of BOG discharged from the second compressor 4 is thereby cooled by the low-temperature reliquefied liquid. As a result, the supply temperature of BOG sent to the reliquefaction plant 5 is kept constant, so that the pressure control apparatus for the cargo tank 1 can be operated smoothly.

Figure 2:
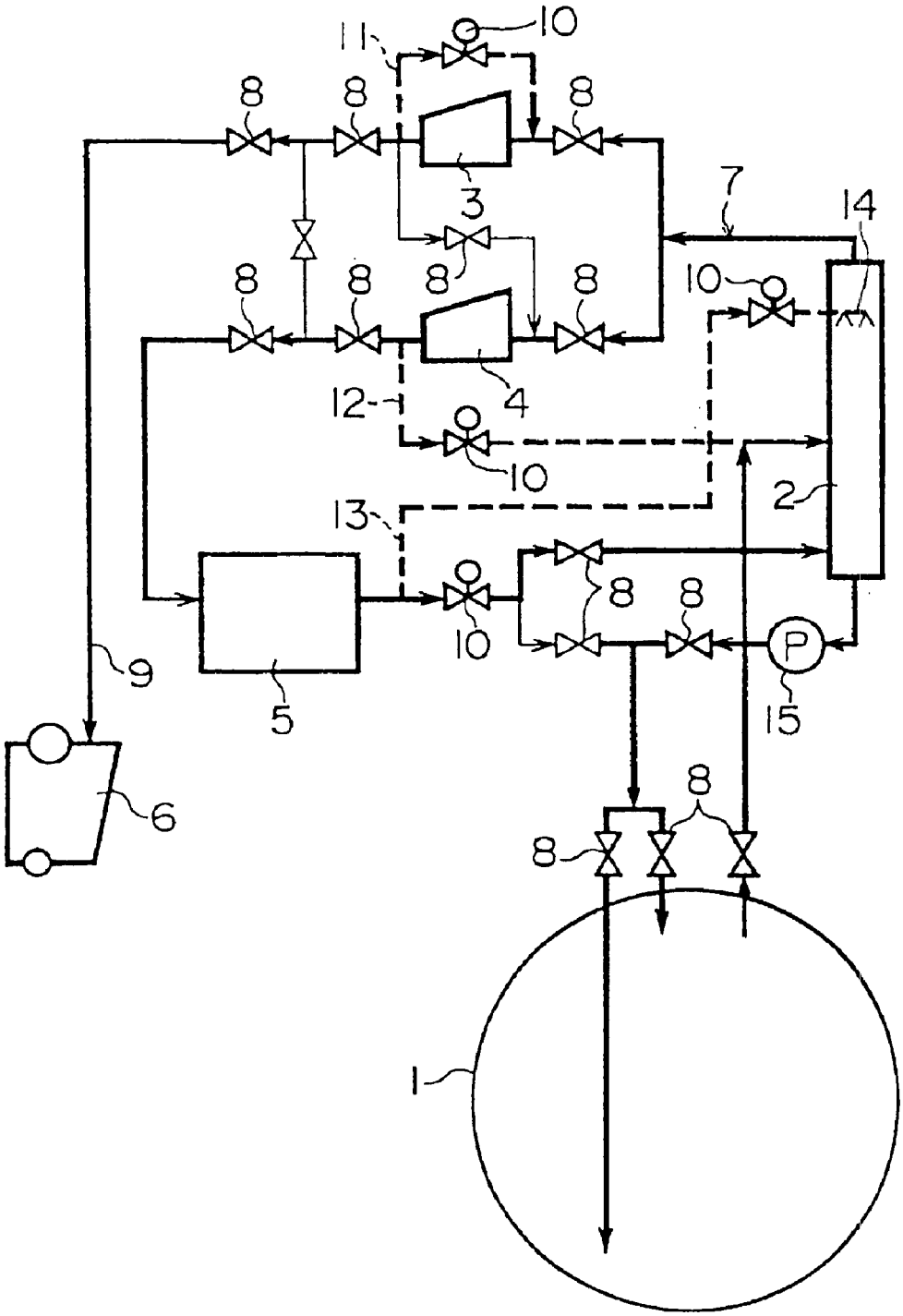
FIG. 2 is a schematic view of a pressure control apparatus for a cargo tank on an LNG carrier in accordance with a second embodiment of the present invention.

FIG. 2 is a schematic view of a pressure control apparatus for a cargo tank on an LNG carrier in accordance with a second embodiment of the present invention.

The pressure control apparatus for a cargo tank on an LNG carrier in accordance with the second embodiment is different from the pressure control apparatus of the first embodiment in that the first compressor 3 and the second compressor 4 are disposed in parallel and that a return pump 15 is disposed between the inlet portion of the cargo tank 1 and a lower end outlet portion of the mist separator 2 as shown in FIG. 2. Specifically, the pressure control apparatus of the second embodiment is configured so that in the case where BOG exceeding the maximum capacity of the reliquefaction plant 5 is treated, the reliquefaction plant 5 and the burning system 6 can be operated in parallel. Also, the return pump 15 is provided to compress BOG so that the BOG can be returned into the cargo tank 1 smoothly because the pressure of BOG is low when the first and second compressors 3 and 4 are operated in parallel.

The burning system 6 is disposed on the downstream side of the first compressor 3, and the reliquefaction plant 5 is disposed on the downstream side of the second compressor 4 and on the upstream side of the cargo tank 1. Moreover, the mist separator 2 is connected to the inlet portions of the first and second compressors 3 and 4 via the gas circulation main line 7 etc., and is connected to the outlet portion of the second compressor 4 via the first sub-line 12 etc. Also, the outlet portion of the reliquefaction plant 5 and a lower inlet portion of the mist separator 2 are connected to each other via the gas circulation main line 7 etc., and the inlet portion of the cargo tank 1 and the lower end outlet portion of the mist separator 2 are connected to each other via the gas circulation main line 7 etc.

The following is a description of a method for controlling the pressure in the cargo tank 1 by using the pressure control apparatus in accordance with the second embodiment of the present-invention.

In the case where the reliquefaction plant 5 is operated in a state of exceeding the maximum capacity thereof, BOG evaporating from the cargo tank 1 passes through the regulating valve 8, the gas circulation main line 7, and the mist separator 2, and is supplied to the reliquefaction plant 5 while being compressed by the second compressor 4, which is one of the BOG compressors, so that the BOG is liquefied by the reliquefaction plant 5. Thereafter, the liquefied liquid is sent to the mist separator 2 through the gas circulation main line 7, the control valve 10, and the regulating valve 8, and is discharged from the lower end outlet portion of the mist separator 2. The discharged liquid is compressed by the return pump 15, and is returned into the cargo tank 1 again and is recovered.

Excess BOG incapable of being treated by the reliquefaction plant 5 is supplied to the burning system 6 through the regulating valves 8 and the BOG burning line 9 while being compressed by the first compressor 3, which is the other of the BOG compressors, so that the BOG is burned. Other methods for controlling the pressure are the same as those in the above-described first embodiment.

According to the apparatus for controlling the pressure in the cargo tank 1 in accordance with the second embodiment of the present invention and the method for controlling the pressure using this apparatus, in the case where BOG exceeding the maximum capacity of the reliquefaction plant 5 is treated, since the reliquefaction plant 5 and the burning system 6 can be operated in parallel, the same effects as those of the first embodiment can be achieved. That is to say, BOG generated in the cargo tank 1 can be treated safely, and the pressure in the cargo tank 1 can surely be controlled so as to be within a specified range.

The above is a description of the embodiments of the present invention. The present invention is not limited to the above-described embodiments, and various changes and modifications can be made without departing from the spirit and scope of the present invention.

Figure 3:
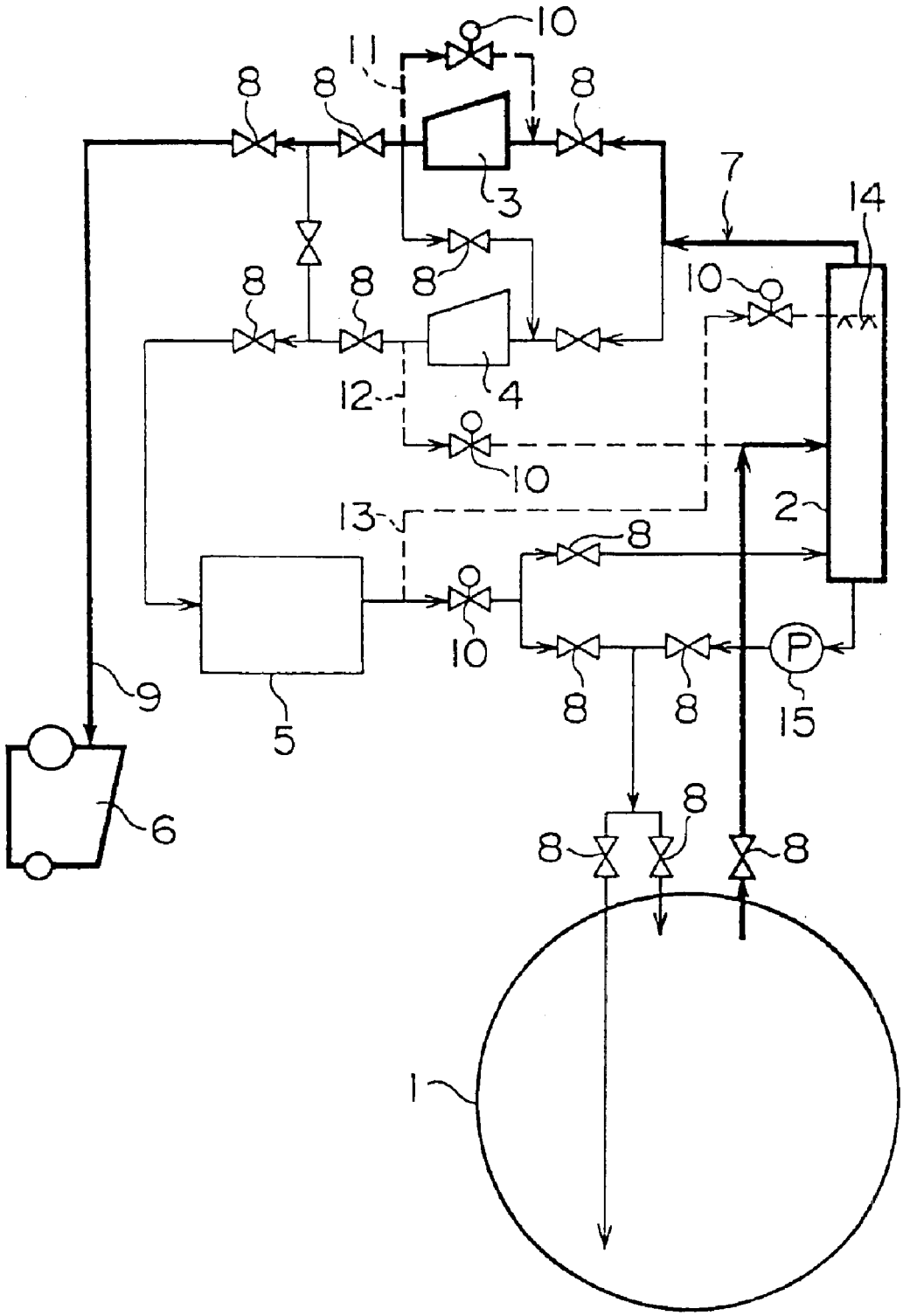
FIG. 3 is a schematic view of a pressure control apparatus for a cargo tank on an LNG carrier in accordance with a second embodiment of the present invention, the view being for illustrating a single operation state of a BOG burning system.
Figure 4:
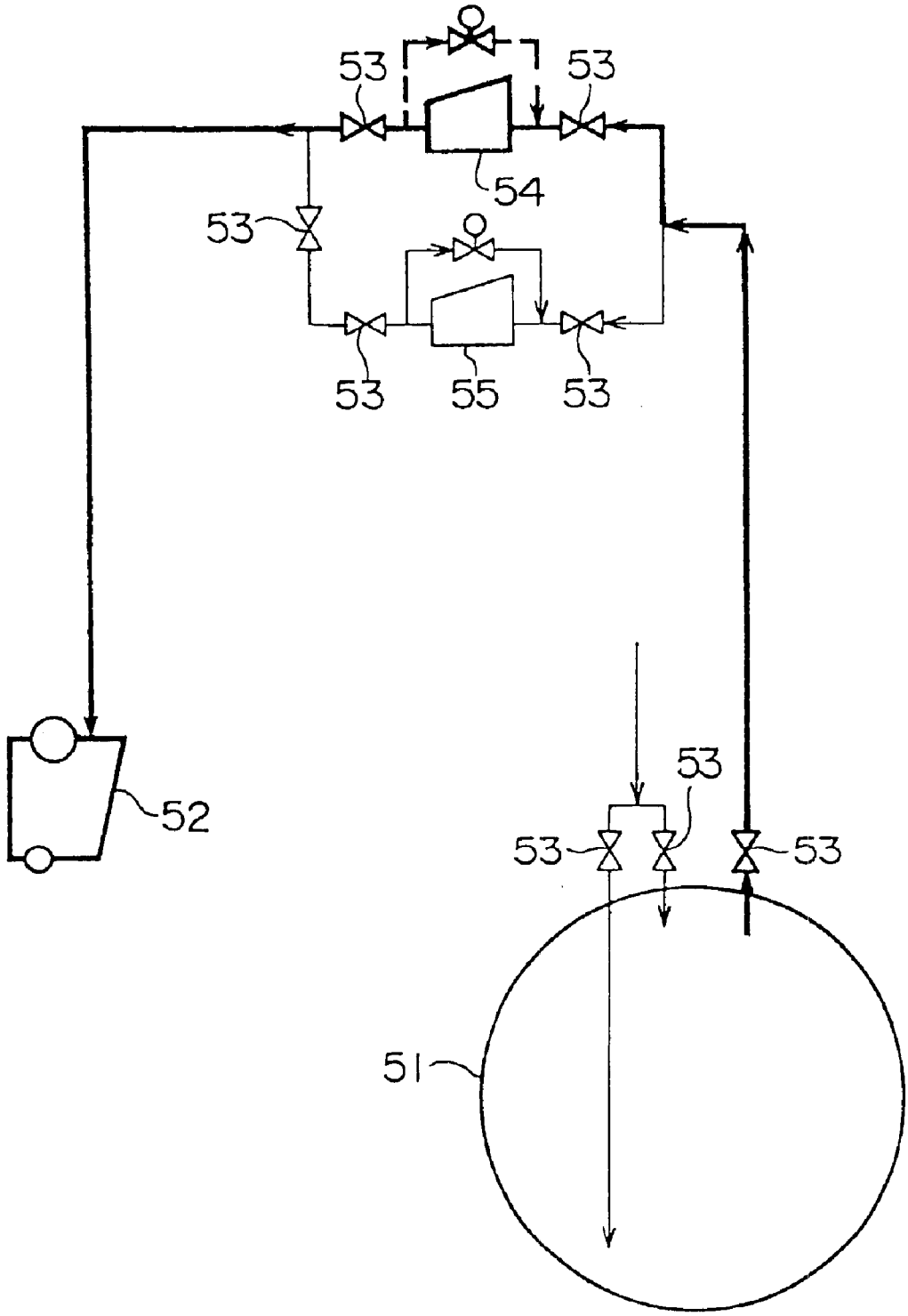
FIG. 4 is a schematic view of a conventional pressure control apparatus for a cargo tank on an LNG carrier.

For example, in the apparatus for controlling the pressure in the cargo tank 1 in accordance with the embodiments of the present invention, by the configuration shown in FIGS. 1 and 2, the burning system 6 is operated singly as shown in FIG. 3 at the start time, at the cold keep operation time, or at the failure time of the reliquefaction plant 5, by which BOG can be treated. Also, since BOG is liquefied more easily when the supply pressure of BOG supplied to the reliquefaction plant 5 is higher, the first and second compressors 3 and 4 may be used selectively. For example, when the reliquefaction plant 5 is used at the maximum capacity, the first and second compressors 3 and 4 are operated in tandem, and when the burning system 6, which does not require high pressure, is used, the first compressor 3 is operated singly.

As described above in detail, according to the present invention, BOG generated in a cargo tank can be treated safely and the pressure in the cargo tank can surely be controlled so as to be within a specified range without a significant increase in equipment cost. Also, a pressure control apparatus for the cargo tank capable of attaining cost reduction and a method for controlling the pressure in the cargo tank by using this apparatus can be provided.

What is claimed is:

1. An apparatus for controlling pressure in a cargo tank on a liquefied natural gas carrier, in which boil-off gas generated from liquefied natural gas stored in the cargo tank is compressed by a compressor, wherein a reliquefaction plant is disposed on the downstream side of said compressor and on the upstream side of said cargo tank so that said boil-off gas discharged from said compressor is liquefied by said reliquefaction plant and the liquefied fluid is returned again into said cargo tank, wherein a mist separator is disposed on the downstream side of said cargo tank to keep the supply temperature of boil-off gas supplied to said reliquefaction plant constant, and said mist separator is connected to an inlet portion and an outlet portion of said compression and also is connected to an outlet portion of said reliquefaction plant.

2. An apparatus for controlling pressure in a cargo tank on a liquefied natural gas carrier, in which boil-off gas generated from liquefied natural gas stored in the cargo tank is supplied to a burning system through a compressor, wherein first and second compressors are disposed in parallel on the downstream side of said cargo tank, and said burning system is disposed on the downstream side of said first compressor and a reliquefaction plant is disposed on the downstream side of said second compressor and on the upstream side of said cargo tank, by which said boil-off gas discharged from said second compressor is liquefied by said reliquefaction plant and the liquefied liquid is returned again into said cargo tank.

3. The apparatus for controlling pressure in a cargo tank on a liquefied natural gas carrier according to claim 2, wherein a mist separator is disposed on the downstream side of said cargo tank to keep the supply temperature of boil-off gas supplied to said reliquefaction plant constant, and said mist separator is connected to inlet portions of said first and second compressors, connected to an outlet portion of said second compressor, and also connected to an outlet portion of said reliquefaction plant, and a return pump is provided between an inlet portion of said cargo tank and an outlet portion of said mist separator.

4. A method for controlling pressure in a cargo tank on a liquefied natural gas carrier, in which boil-off gas generated from liquefied natural gas stored in the cargo tank is compressed by a compressor, wherein by using a reliquefaction plant disposed on the downstream side of the compressor and on the upstream side of said cargo tank, and a mist separator disposed on the downstream side of said cargo tank, said boil-off gas passing through said mist separator and discharged from said compressor is liquefied by said reliquefaction plant, and the liquefied fluid is returned again into said cargo tank; some of said boil-off gas discharged from said compressor is supplied to said mist separator while being mixed with said boil-off gas evaporating from said cargo tank; and some of reliquefied fluid liquefied by said reliquefaction plant is sprayed into said mist separator so that the boil-off gas supplied from said compressor and said cargo tank is cooled by the sprayed reliquefied fluid, whereby the supply temperature of boil-off gas supplied to said reliquefaction plant is kept constant.

5. A method for controlling pressure in a cargo tank on a liquefied natural gas carrier, in which boil-off gas generated from liquefied natural gas stored in the cargo tank is supplied to a burning system through a compressor, wherein by using a second compressor disposed in parallel with a first compressor, connected with said burning system, on the downstream side of said cargo tank, a reliquefaction plant disposed on the downstream side of said second compressor and on the upstream side of said cargo tank, a mist separator disposed on the downstream side of said cargo tank, and a return pump provided between an inlet portion of said cargo tank and an outlet portion of said mist separator, said boil-off gas passing through said mist separator and discharged from said second compressor is liquefied by said reliquefaction plant, and the liquefied fluid is returned again into said cargo tank through said mist separator and said return pump; some of said boil-off gas discharged from said second compressor is supplied to said mist separator while being mixed with said boil-off gas evaporating from said cargo tank; and some of reliquefied fluid liquefied by said reliquefaction plant is sprayed into said mist separator so that the boil-off gas supplied from said second compressor and said cargo tank is cooled by the sprayed reliquefied fluid, whereby the supply temperature of boil-off gas supplied to said reliquefaction plant is kept constant.

6. An apparatus for controlling pressure in a cargo tank on a liquefied natural gas carrier in which boil-off gas generated from liquefied natural gas stored in the cargo tank is compressed by a compressor, wherein a reliquefaction plant is disposed on the downstream side of said compressor and on the upstream side of said cargo tank so that said boil-off gas discharged from said compressor is liquefied by said reliquefaction plant and the liquefied fluid is returned again into said cargo tank and wherein two compressors connected in series are disposed on the upstream side of said reliquefaction plant, and wherein a mist separator is disposed on the downstream side of said cargo tank to keep the supply temperature of boil-off gas supplied to said reliquefaction plant constant, and said mist separator is connected to an inlet portion and an outlet portion of said compressors and also is connected to an outlet portion of said reliquefaction plant.

* * * * *